United States Patent [19]

Marchello et al.

[11] 4,044,531

[45] Aug. 30, 1977

[54] PROTECTIVE NOSE SHIELD FOR RACE HORSES AND THE LIKE

[76] Inventors: John L. Marchello, 9934 Daleview, South Lyon, Mich. 48178; Gerald F. Trotter, 43263 Eleven Mile Road, Novi, Mich. 48050

[21] Appl. No.: 680,066

[22] Filed: Apr. 26, 1976

[51] Int. Cl.[2] ..... B68C 5/00

[52] U.S. Cl. ..... 54/80; 128/212

[58] Field of Search ..... 54/80, 10; 119/143, 119/129, 130, 131; 128/212, 146.6, 140 N, 205, 206

[56] References Cited

U.S. PATENT DOCUMENTS

| | | | |
|---|---|---|---|
| 381,285 | 4/1888 | Shue | 54/80 |
| 468,238 | 2/1892 | Cather | 54/80 |
| 3,173,401 | 3/1965 | Lupo, Sr. | 54/80 |
| 3,491,755 | 1/1970 | Barghini et al. | 128/212 |
| 3,609,941 | 10/1971 | Eldredge | 128/212 |

*Primary Examiner*—Louis E. Mancene
*Assistant Examiner*—Peter K. Skiff
*Attorney, Agent, or Firm*—Cullen, Settle, Sloman & Cantor

[57] ABSTRACT

A dual purpose protective nose shield for race horses which includes a pair of generally cup-shaped reverse air scoops positioned over the horse's nostrils. Each scoop has a rearwardly flared deflection shield which prevents cold frigid air and/or mud or other foreign debris from the track from impinging directly upon the nostrils. The rearwardly facing breathing port of the scoop channels inhaled and exhaled air into an air space which is formed by the scoop about the nostril. The incoming cold air is warmed as it contacts the outgoing exhaled air and by the body heat generated by the portion of the horse's face over which it is channeled so as to prevent damage to the nostrils and impaired or shallow breathing often caused by the direct inhalation of cold frigid air.

9 Claims, 6 Drawing Figures

PROTECTIVE NOSE SHIELD FOR RACE HORSES AND THE LIKE

BACKGROUND OF INVENTION

The invention relates to a protective nose shield for race horses and more particularly to a dual purpose reverse air scoop nose shield which deflects cold air and foreign debris from directly contacting the nose area while slightly warming the air before it is inhaled.

Horses, unlike many other animals, breathe in and out only through their nostrils. They do not breathe in and out through their mouths. Some animals, such as camels, have flaps on both nostrils to protect the animal against the environment. Horses have no such means of natural protection.

In cold weather, horses will tend to race with their heads down so as to avoid the direct inhalation of cold frigid air through the nostrils. In racing type situations this cannot be permitted. Many racing horses have their nostrils injured or clogged from pieces of mud, sand, or other debris flying up from the track. In addition to causing injury to the sensitive nostrils, these foreign particles often clog the nostrils making breathing difficult.

In the colder months, the nostrils expand when exposed directly to the frigid blasts of cold air often causing blood vessels to rupture and noses to become sore or sensitive. Furthermore, the direct inhalation of cold air will normally result in "blowing," i.e., a fast, shallow breathing which restricts the amount of oxygen available to the horse for running purposes and can induce hypothermia.

While these problems have been recognized, prior art attempts to solve the problems have been unsuccessful. Masking devices have been too bulky, heavy or uncomfortable to the horses and they were often too complex, expensive and difficult to maintain. Some of these devices have the additional disadvantage of protruding beyond the nose of the horse so as to create problems in photo finishes which prevents commercial acceptance.

The present invention eliminates all of the deficiencies of the prior art and provides a dual function nose shield capable of (1) deflecting cold air and/or foreign objects or debris to prevent direct contact with the nostrils, and (2) preheating or warming the relatively cold air before it is inhaled by the horse.

BRIEF SUMMARY OF THE INVENTION

The present invention involves a dual function nose shield for a race horse which includes a deflector shield for preventing cold air and/or foreign debris from impinging directly upon the horse's nostrils, a convex or domed portion contiguous with the rear of the deflector shield for forming a semi-enclosed air space adjacent to the nostrils and a rearwardly facing air scoop opening or breathing port at the rear of the convex or domed portion for channeling inhaled and exhaled air into and out of the air space so as at least partially heat the relatively cold incoming air before it enters the horse's nostrils by contact with the relatively warm exhaled air and by the body heat generated by the portion of the horse's face over which the incoming air is channeled.

More specifically, the protective nose shield of the present invention comprises a pair of reverse air scoop members and fastening means for adjustably positioning each of the scoop members over one of the horse's nostrils. Each of the scoop members includes a domed portion which forms an air space about the nostril and a rearwardly flared deflection surface integral with the front of the domed portion for diverting foreign debris and cold air away from the nostril area. A rearwardly facing breathing port is provided in the rear of the domed portion for channeling the inhaled and exhaled air into and out of the air space so as to warm incoming air.

The present invention provides a dual protective function rather than a single shielding function. Firstly, the nose shield prevents the cold air from flowing directly into the nostrils while simultaneously deflecting any mud, sand or other foreign debris from entering the nostrils. Thus, the damage which could be caused by the mud and dirt or by the cold air is eliminated. Breathing difficulties resulting from clogged nostrils is similarly eliminated.

Secondly, the ruptured blood vessels resulting from directly inhaled cold frigid air and "blowing" or rapid shallow breathing which prevents the horse from obtaining sufficient oxygen and may lead to hypothermia is prevented by the reverse air scoop feature which preheats the inhaled air before it enters the nostrils by channeling the air from the rear toward the nostril so as to preheat it with the relatively warmer exhaled air and by the body heat generated by the facial portion of the horse's face over which the inhaled air is drawn.

The nose guard or shield of the present invention offers no interference with the normal breathing of the horse under ordinary conditions and, under cold weather conditions, the breathing characteristics are greatly enhanced and the horse is allowed to draw deeper breaths thereby obtaining more oxygen and enabling the horse to run better without breathing difficulty or nose injuries.

The nose shield of the present invention is relatively simple in construction, inexpensive, lightweight, comfortable to wear, easy to mount, and easy to maintain and clean. No portion of the nose shield protrudes beyond the end of the horse's nose thereby rendering the apparatus both morally and technically acceptable since this eliminates any photo-finish problems heretofore encountered.

Since a racing horse requires great volumes of air to run at optimum speed, the nose shield of the present invention will improve both the morale and the speed of the animal since he is not sucking in raw, frigid blasts of air or inhaling mud clots from the horses up ahead. This invention will greatly reduce nose injuries and bleeding problems and will greatly improve the race times which have traditionally gotten slower in colder weather.

The dual function nose shield of the present invention avoids all of the problems of the prior art; prevents physical injury to the animals wearing the device; and, greatly improves cold weather race times.

BRIEF DESCRIPTION OF THE DRAWINGS

Other advantages and meritorious features of the present invention will be more fully understood from the following detailed description of the drawings and the preferred embodiment, the appended claims and the drawings, in which:

DESCRIPTION OF THE PREFERRED EMBODIMENT

Figure 1:
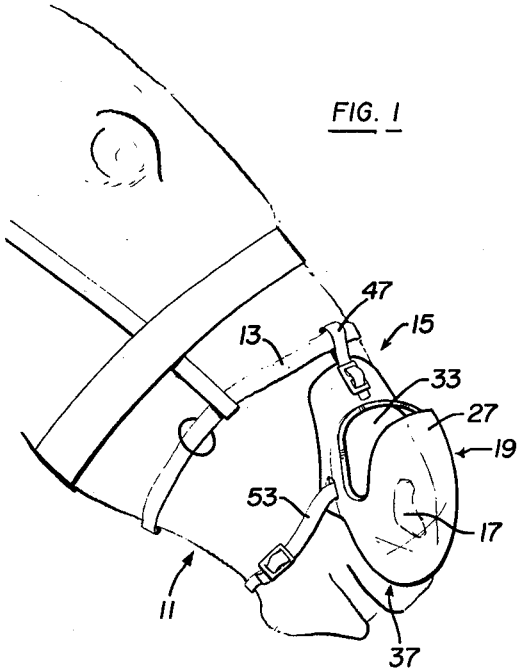
FIG. 1 illustrates a perspective side view of a portion of a horse's head with the nose shield of the present invention attached thereto.

FIG. 1 illustrates a horse's head 11 to which a conventionally known halter 13, only a portion of which is shown, is attached. The nose shield 15 of the present invention is illustrated as being properly positioned over the nostrils 17 of the horse and adjustably fastened as hereinafter described.

The nose shield 15 of the present invention can be made from any suitable material. In the preferred embodiment disclosed herein the nose shield 15, absent the fastening means, was molded as a single integral piece of relatively soft, substantially translucent or transparent plastic material such as polyethylene or the like, although any similar, conventionally-known material could be used. The material must be sufficiently rigid to hold its shape while being soft or flexible enough to avoid irritating the sensitive areas of the horse's nose about the nostrils or otherwise causing discomfort to the horse. The material is relatively lightweight and easy to clean and the entire nose shield apparatus 15 can be easily and quickly attached, adjustably positioned, or removed.

Figure 2:
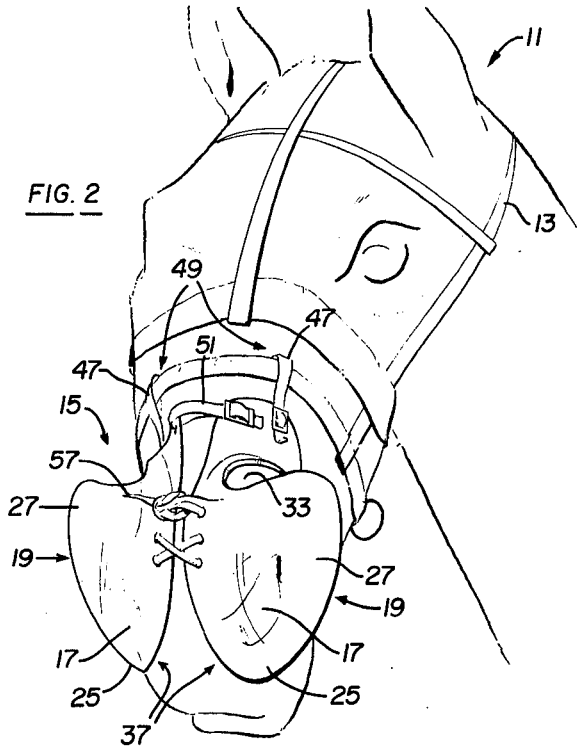
FIG. 2 represents a perspective frontal view of a horse's head equipped with the nose shield of the present invention.
Figure 3:
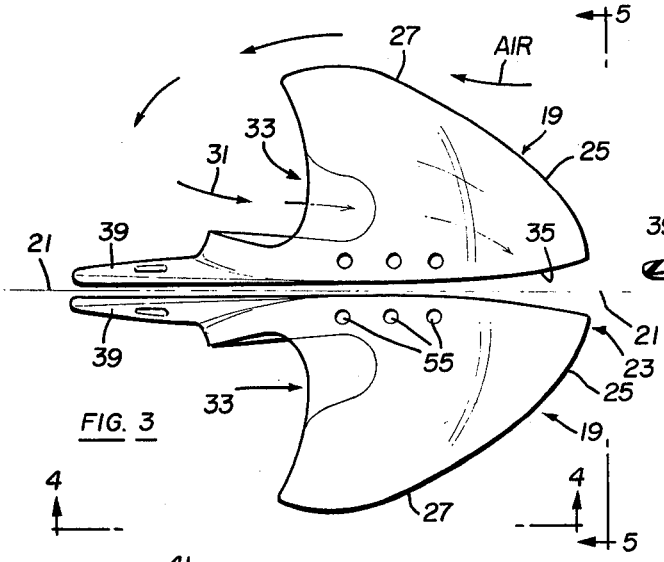
FIG. 3 illustrates a top plan view of the nose shield device of the present invention.
Figure 6:
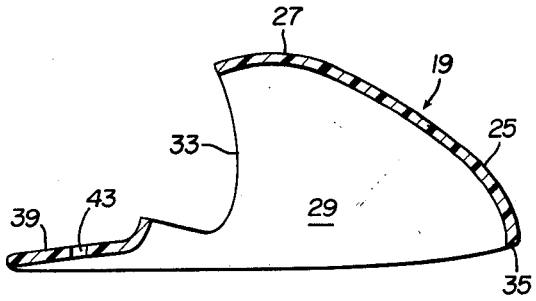
FIG. 6 is a fragmentary cross-sectional view of one piece of the nose shield device taken along view lines 6—6 of FIG. 4 to show its hollow interior.
Figure 4:
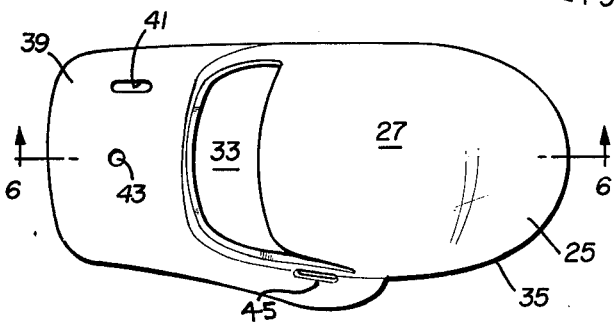
FIG. 4 represents a side view of the nose shield of FIG. 3 taken along view lines 4—4 of FIG. 3.
Figure 5:
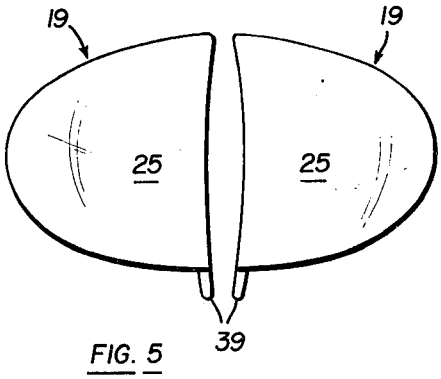
FIG. 5 is a front view of the nose shield of FIG. 3 taken along view lines 5—5 of FIG. 3.

As illustrated in FIGS. 1 and 2, the nose shield 15 of the present invention includes a pair of cup-shaped members or reverse air scoops 19. Each of the scoops 19 are positioned over one of the nostrils 17 and as illustrated in FIGS. 3, 4, 5 and 6, each scoop or cup-shaped element 19 has the general shape of an ovoid bisected along its longitudinal axis 21. The forward or front end 23 of each of the scoops 19 includes a rearwardly flared shield or deflection surface 25 which is contiguous to and integral with a central convex or domed portion 27 which forms a semi-enclosed air space 29 around and above the nostril 17. The air space 29 is interior to the domed portion 27 and is represented by the reference numeral 29 in FIGS. 3 and 6, signifying that the air space exists within the interior of the portion of the scoop 19 formed by the shield portion 25 and the domed portion 27. At the rear 31 of the cup-shaped element 19, a rearwardly facing breathing port or air scoop opening 33 is provided for passing the inhaled and exhaled air.

Each of the scoops 19 has a bottom or interior rim or lip portion 35 which rests against the horse's face when properly positioned without causing any discomfort thereto. The rim portion 35 forms an effective seal between the shield portion 25 of the scoop 19 and the area 37 in front of and adjacent to either side of the nostril 17 so that no cold air or foreign debris can avoid the shield 25 and directly enter the nostril 17. The rear portion of the rim 35 extends into a flange portion 39 which is adapted to rest comfortably flush against the side and top of the horse's face. The flange portion 39 has a first fastener anchoring means or aperture 41 near the top rear portion thereof; a second fastener anchoring means or aperture 43 located at the central portion of the flange 39; and a third fastener anchoring means or aperture 45 located at the lower central portion of the scoop 19 at the forward end of the flange 39.

The pair of scoops 19 of the nose shield 15 of the present invention are attached as illustrated in FIGS. 1 and 2. A first adjustable fastening means such as a strap 47 has one end attached to or threaded through the aperture 43 and its opposite end attached to the portion of the horse's halter 13 indicated at 49. The strap 47 prevents the scoop 19 from sliding forward toward the nose of the horse 11.

A second adjustable fastening means such as a strap 51 has its opposite ends attached to or through the fastener anchors or apertures 41 of the pair of scoops 19 and passing across the bridge of the horse's nose so as to hold the rear end 31 of the flange portions 29 coupled together.

A third adjustable fastening means such as an elastic strap 53 has its opposite ends attached to or through the fastener anchors or apertures 45 at the lower central portion of the scoops 19 at the forward end of the flange 39. The strap 53 passes under the horse's lower jaw as illustrated in FIG. 1.

Lastly, a plurality of apertures 55 may be provided on the top central portions of the scoops 19 adjacent the rim portions 35 and a string, cord or similar tying means 57 may be threaded through the apertures 55 to pull the forward or central portions of the scoops 19 together to insure proper positioning of the nose shield 15 over the nostrils 17, as desired. Since the breathing ports 33 face toward the rear, the sound of the horse's breathing is directed towards the rider thereby enabling him to position or adjustably reposition the nose shield 15 as required for optimum results.

When the dual purpose nose shield 15 of the present invention is properly attached to the horse 11 as shown in FIG. 2, the forward rim portion 35 effectively forms a seal between the base of the scoop 19 and the horse's face as indicted at 37 forward of and to both sides of the nostrils 17 so that no cold air or foreign debris can directly enter the nostril 17 via this route. The rearwardly flared shielding surface 25 deflects any mud, dirt or foreign debris completely away from the horse's nostrils 17 and it prevents any impairment to breathing or damage to the nostril itself. Secondly, the cold frigid air is directed away from the area of the nostrils 17 and up over the domed portion 27. The airspace 29 adjacent the nostril 17 and the rearwardly facing reverse scoop opening 33 are sufficiently large so that breathing is never impaired.

All breathing, both inhaling and exhaling, takes place through the breathing port 33. The cold frigid air which was diverted or deflected over the shield surface 25 passes to the side and rear of the horse's face. When the horse inhales, the relatively cold air is drawn into the reverse air scoop opening 33 and is channeled toward the nostril 17. During its passage through the opening 33 and to the nostril 17, the air is preheated to some extent since it is warmed (1) by contact with the relatively warmer air being exhaled through the opening 33, (2) by the body heat generated by the portion of the horse's face over which the air is channeled from the opening 33 to the nostril 17, and (3)by the thermal characteristics of the airspace 29 formed within the cup-shaped element 19.

Therefore, when the horse is running in cold weather, the nose shield or mask 15 of the present invention prevents injury or irritation to the nostrils 17, prevents "blowing" and allows the horse to take deeper breaths containing more oxygen thereby generally increasing the horse's speed over what it would normallyhave been under cold weather or bad track conditions.

With this detailed description of the specific apparatus used to illustrate the prime embodiment of the present invention and the operation thereof, it will be obvious to those skilled in the art that various modifications can be made in the present protective nose shield and in the configuration and materials recited herein without departing from the spirit and scope of the invention which is limited only by the appended claims.

We claim:

1. A protective nose shield for race horses and the like whose head and face portions normally carry bridle means, said protective nose shield comprising a pair of reverse air scoop members and fastening means operably coupling said air scoop members to said bridle means and about portions of said horses face for adjustably positioning each of said air scoop members over one of the horse's nostrils, each of said air scoop members including a domed portion forming an air space about the nostril, a rearwardly flared deflection surface integral with the front of said domed portion for diverting foreign debris and cold air away from the nostril area, said domed portion including an inwardly facing rim portion adapted to rest comfortably against the horse's face and to fit relatively closely thereto to prevent the passage of cold air or foreign debris into said air space from the front or side of said domed portion, and a rearwardly facing breathing port in the rear of said domed portion at the opposite end of said domed portion from said deflection surface for channeling the inhaled and exhaled air into and out of said air space such that the cold incoming air is at least slightly warmed by contact with the warmer exhaled air and by the body heat generated by the portion of the horse's face over which the incoming air is drawn.

2. The protective nose shield of claim 1 further characterized in that each of said reverse air scoop members is generally shaped as a longitudinally bisected ovoid having its arcuate top serving as said domed portion, its longitudinal arcuate front end serving as said deflection surface, and at least a substantial section of its longitudenal arcuate rear portion being cut away to form said reverse air scoop breathing port for channeling the inhaled and exhaled air into and out of said air space formed within said domed portion.

3. The protective nose shield of claim 1 further characterized in that each of said scoop members are formed as a single integral piece from a relatively soft lightweight plastic material which is comfortable to the horse and easy to clean and even further characteried in that the forwardmost portion of said scoop members do not protrude beyond the end of the horse's nose thereby avoiding photofinish questions.

4. The protective nose shield of claim 1 further characterized in that each of said scoop members includes a flange portion about the rear portion thereof and wherein said fastening means includes strap means secured to said flange portion for fastening said scoop members to a portion of the horse's halter; wherein said fastening means further includes a second strap means adjustably secured to the outside bottom of said flange portions and passing under the horse's lower jaw to secure the two scoop members together; and wherein said scoop members are provided with apertures adjacent the top central rim portions and said fastening means further includes tie means for engaging said apertures and adjustably fitting said nose shield properly on the horse's face.

5. A dual function nose shield for a race horse or the like comprising a deflector shield for preventing foreign debris and cold air from impinging directly upon the horse's nostril, the forward and side edge portions of said deflector shield being adapted to rest comfortably against the horse's face and to fit relatively closely thereto to prevent the passage of cold air or foreign debris between said edge portions and that portion of the horse's face against which said edge portions are disposed, a convex portion contiguous with the rear of said deflector shield for forming a semi-enclosed air space adjacent said nostril, the front and side portions of said semi-enclosed air space being closed to the passage of air into said air space by said edge portions of said deflector shield, and a rearwardly facing air scoop opening at the rear of said convex portion for channeling inhaled and exhaled air into and out of said air space so as to at least partially heat relatively cold incoming air before it enters the nostril by contact with the warm exhaled air and the heat generated by the portion of the horse's face over which the incoming air is channeled, and means for adjustably positioning said deflector shield, including said convex portion and said rearwardly facing air scoop, in operative position over the horse's nostril.

6. The nose shield of claim 5 further characterized in that it comprises two substantially identical, symmetrically opposed, generally cup-shaped members each of which members is adapted to be positioned over a separate nostril, each of said cup-shaped members including a separate deflection shield, convex portion and air scoop opening and each member being a single unitary piece of easy-to-clean material.

7. The nose shield of claim 6 further characterized in that each of said cup-shaped members includes a rim portion adapted to rest comfortably against the horse's face while simultaneously sealing the front and side portions around the nostril to prevent the nostril from being directly impinged by said foreign debris or cold air.

8. The nose shield of claim 7 further characterized in that each of said cup-shaped members includes a flange portion about the rear sides and end thereof adapted to lie flush against the horse's face without discomfort and wherein said positioning means includes a plurality of fastening means for operatively engaging said flange portion and passing about a portion of the horse's face for adjustably positioning said cup-shaped members properly over the nostrils.

9. The nose shield of claim 8 further characterized in that said fastening means includes strap means having one end attached to said flange portion proximate the rear thereof for fastening said cup-shaped members to a portion of the horse's halter to prevent forward movement of the members along the horse's nose; a second adjustable strap means having its opposite ends coupled to the top rear sides of said flange portion for securing said pair of cup-shaped members together over the top of the upper nose; a third adjustable strap means having its opposite ends coupled to the top forward sides of the flange portion and passing under the lower jaw for holding said pair of cup-shaped members in place; and tie means for coupling the top central portions together across the top forward portion of the upper jaw to properly position the cup-shaped members over the nostrils.

* * * * *